US007152767B2

(12) United States Patent
Seelhofer

(10) Patent No.: US 7,152,767 B2
(45) Date of Patent: Dec. 26, 2006

(54) TAMPER-EVIDENT CLOSURE FOR LIQUID CONTAINERS AND BULK CONTAINERS

(75) Inventor: Fritz Seelhofer, Lindau (CH)

(73) Assignee: SIG Technology Ltd., Neuhausen am Rheinfall (CH)

( * ) Notice: Subject to any disclaimer, the term of this patent is extended or adjusted under 35 U.S.C. 154(b) by 202 days.

(21) Appl. No.: 10/250,735

(22) PCT Filed: Jan. 4, 2002

(86) PCT No.: PCT/CH02/00002

§ 371 (c)(1),
(2), (4) Date: Dec. 29, 2003

(87) PCT Pub. No.: WO02/053469

PCT Pub. Date: Jul. 11, 2002

(65) Prior Publication Data

US 2004/0089165 A1 May 13, 2004

(30) Foreign Application Priority Data

Jan. 5, 2001 (CH) ..... 7/01

(51) Int. Cl.
*B67D 3/00* (2006.01)
*B67D 5/00* (2006.01)
*B65D 47/00* (2006.01)
*B65D 47/01* (2006.01)

(52) U.S. Cl. ..... 222/536; 222/81; 222/541.2; 222/556

(58) Field of Classification Search ..... 222/81–91, 222/526–537, 153.07, 541.2, 546, 517, 556
See application file for complete search history.

(56) References Cited

U.S. PATENT DOCUMENTS

| | | | | |
|---|---|---|---|---|
| 2,893,611 | A * | 7/1959 | Akers | 222/536 |
| 5,065,912 | A * | 11/1991 | Rosenthal | 222/517 |
| 5,332,131 | A * | 7/1994 | Pehr | 222/505 |
| 5,884,793 | A | 3/1999 | Wang | |
| 6,161,728 | A * | 12/2000 | Dark | 222/83 |
| 6,257,449 | B1 * | 7/2001 | Baerenwald | 222/83 |

FOREIGN PATENT DOCUMENTS

| | | |
|---|---|---|
| FR | 2 789 659 A1 | 8/2000 |
| GB | 2 098 184 A | 11/1982 |

* cited by examiner

*Primary Examiner*—Kevin Shaver
*Assistant Examiner*—Melvin A. Cartagena
(74) *Attorney, Agent, or Firm*—Pauley Petersen & Erickson

(57) ABSTRACT

A guarantee closure having a closure body with a guarantee foil and a pour-out spout as well as a closure cap fitting onto the closure body. The pour-out spout is arranged on the closure body such that it may be pivoted up. The guarantee foil, by pivoting-up the pour-out spout into the pour-out position, is cut open and thus frees the passage to the pour-out spout. The closure body comprises a relief for receiving the guarantee foil and forms above the relief, by two shoulders arranged over one another and distanced from one another, a free space for receiving the lying pour-out spout. This is enclosed and held by a film-hinge material bridge which in the lying condition connects the two shoulders with a surface which seen from the outside is concave and on the upper side of the lying pour-out spout runs together to a point which defines the pivoting axis of the pour-out spout. On pivoting up the pour-out spout the film-hinge material bridge snaps into a permanent shape which is convex when viewed from the outside and thus holds the pour-out spout in the closure position.

12 Claims, 5 Drawing Sheets

TAMPER-EVIDENT CLOSURE FOR LIQUID CONTAINERS AND BULK CONTAINERS

BACKGROUND OF THE INVENTION

1. Field of the Invention

This invention relates to a guarantee closure for fluid containers or free-flowing material containers for packaging things like salt, sugar and similar free-flowing or pourable substances. With a guarantee closure, on opening for the first time, a guarantee foil or the packaging skin itself must be cut open.

2. Discussion of Related Art

Many closures of foodstuff containers and bottles as also closures for containers for cleaning agents or any types of liquids such as lubrication oils, chemicals and likewise are designed as guarantee closures. If the closure lid is removed the contents remains hermetically sealed until a guarantee seal formed as a sealing foil is separately pierced or removed.

As an example of a guarantee closure, there is a known plastic closure with a closure body and associated lid, as is used for ketchup bottles. The closure body has a pour-out spout directed upwards and on its lower side there is an aluminium foil which is applied or adhered on and acts as a guarantee seal or guarantee closure. If a new bottle is opened for the first time then in some cases first a guarantee strip is removed, and the closure lid is flipped up. The closure lid is designed as a cap and when the cap is snapped shut it encloses a hollow space on the closure body. The closure body is screwed onto the bottle thread. Arranged on the closure body is a pour-out spout which stands upright on the closure body shoulder and which is set free on flipping up the closure cap. This pour-out spout is closed on the lower side by a guarantee closure in the form of an aluminium foil applied below the closure body. Thus, before one may pour out ketchup for the first time, the aluminium foil at the lower end of the pour-out spout must be pierced. Conventionally this is done with a sharp object, for example with the tip of a knife. With this there is a disadvantage that the foil is not cleanly cut away along the inner edge of the spout, but rather is irregularly torn to a greater or lesser extent. Individual brows of the aluminium foil may subsequently still project into the pour-out spout or even released from the aluminium foil may come out with the contents on pouring out. For opening such a closure or its guarantee foil for the first time an additional tool, such as a knife or a needle must be used. Furthermore this opening of the guarantee foil is not effected systematically and in a technically clean manner which would ensure a complete release of the flow cross section of the pour-out spout.

The fluid container does not need to be a bottle but can also be a cardboard carton as used for all types of fruit juices, lemonades, fresh water, tea and milk products. Cardboard cartons are also used for packaging free-flowing material such as sugar, salt and likewise. With these cardboard cartons there is always a problem of how the cardboard carton is opened where the closure is seated. With these cardboard cartons specifically it is the cardboard itself which assumes the role of the guarantee foil and the cardboard carton therefore after opening or on opening the closure must by pierced or cut open, which until now had to be effected by a separate working step and often is only accomplished with the help of tools.

SUMMARY OF THE INVENTION

It is one object of this invention to provide a guarantee closure for liquid and free-flowing containers which overcomes the above mentioned disadvantages and which on opening the closure for the first time the guarantee foil is cleanly opened and at the same time it is ensured that a cross section of the pour-out spout is set free and also remains held free.

This object is achieved by a guarantee closure for a liquid and free-flowing material container, having a closure body with a pour-out spout arranged lying therein in the initial position but which may be pivoted up out of this position and which with respect to the closure body is sealingly enclosed by a film-hinge material bridge. When on pivoting up the film-hinge bridge, the pour-out spout springs from a concave into a convex shape and vice-versa and thus retains the pour-out spout in the end positions of its pivoting range, as well as with an associated guarantee foil which in the lying position of the pour-out neck extends below and along this, and the pivoting axis on the pour-out neck lies at such a location that its rear section on pivoting Up the pour-out neck pivots downwards. The rear end of the pour-out neck tapers into a tip which at the beginning of the pivoting-up movement of the pour-out neck tears open the guarantee foil extending below the pour-out neck. The pour-out neck on the side which faces the guarantee foil forms a wedge-shaped cut-edge which on pivoting up the pour-out neck cuts open the guarantee foil.

BRIEF DESCRIPTION OF THE DRAWINGS

Different embodiments of this guarantee closure are shown in the drawings in various positions and are explained in detail in the specification, wherein the drawings show.

DESCRIPTION OF PREFERRED EMBODIMENTS

Figure 1:
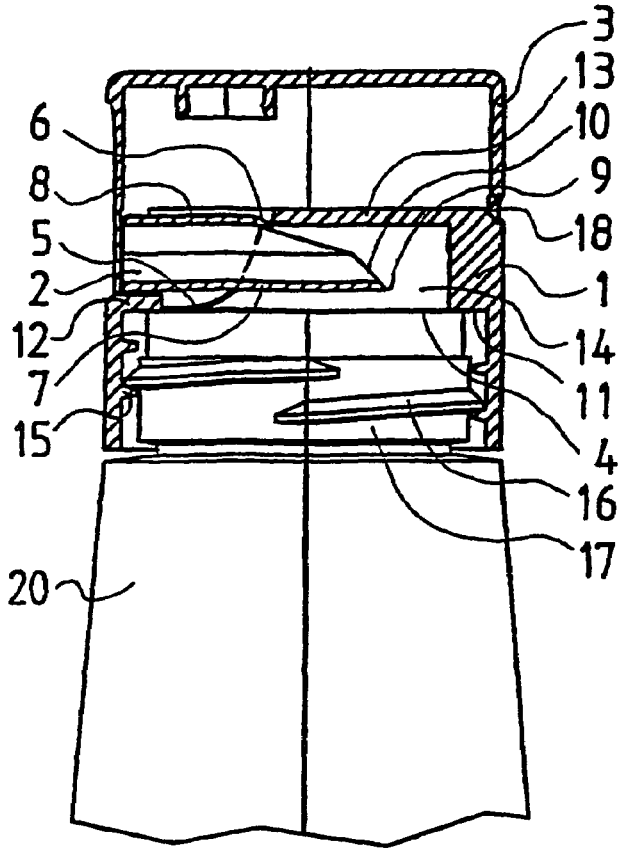
FIG. 1 is a longitudinal sectional view of a guarantee closure, placed onto a bottle, in a closed position before a first use of the bottle.

FIG. 1 shows the guarantee closure in a longitudinal section along the axis of the bottle 20 which is only indicated. The guarantee closure has a closure body 1, a pour-out spout 2 and a closure cap 3 fitting the closure body 1. The closure cap 3 is connected to the closure body 1 as one piece so that it may be flipped up on it. It is also possible to manufacture the closure cap 3 as a separate piece, either equipped with snap-closures so that it may be stuck onto the Closure body or equipped with an inner thread and thus may be screwed onto a fitting outer thread on the closure body 1. The closure body 1 on the lower side forms a relief 11 extending around on which there is applied or adhered a guarantee foil 4. The guarantee foil 4 ensures that the closure hermetically seals the container or the bottle 20 and simultaneously ensures that the first user that opens the closure is also the first user to remove fluid out of the container or the bottle 20. In the example shown here the closure body 1 with an inner thread 15 is screwed onto the outer thread 16 on the bottle neck 17 of the bottle 20. One aspect of this guarantee closure is that the pour-out spout 2 is arranged on the closure body 1 such that it may be pivoted up, wherein the guarantee foil 4 by pivoting up the pour-out spout 2 in its pour-out position by itself is automatically cut open. For this purpose, the pour-out spout 2 is held lying between two shoulders 12, 13 which are formed on the closure body 1 and arranged over one another at a distance to one another. To be more exact the pour-out spout 2 is held by a film-hinge material bridge 5 which sealingly encloses the whole pour-out spout 2 and connects the two shoulders 12, 13 on the closure body 1. In the FIG. 1 which shows the guarantee closure before its first opening, the pour-out connection piece or spout 2 is accommodated in the free space 14 which is limited above and below by the two shoulders 12, 13 of the closure body 1, as well as laterally by its wall which stands perpendicular to the shoulders. In this position of the pour-out spout 2 the film-hinge material bridge 5 seen from the outside, that is to say from the left, forms a concave surface. Above the pour-out spout 2 where the material bridge 5 enclosing the pour-out spout 2 runs together, the point 6 forms a rotation axis 6 for the pour-out spout 2. As shown, the pour-out spout 2 on its lower side 7, towards the right, thus towards that end which is to be pivoted towards the container 20, is longer than on the upper side 8 and tapers into a tip 9. Thus from its wall there are formed two edges 10 which taper at an askew angle to the tip 9. These outer edges 10 act as cutting edges.

Figure 2:
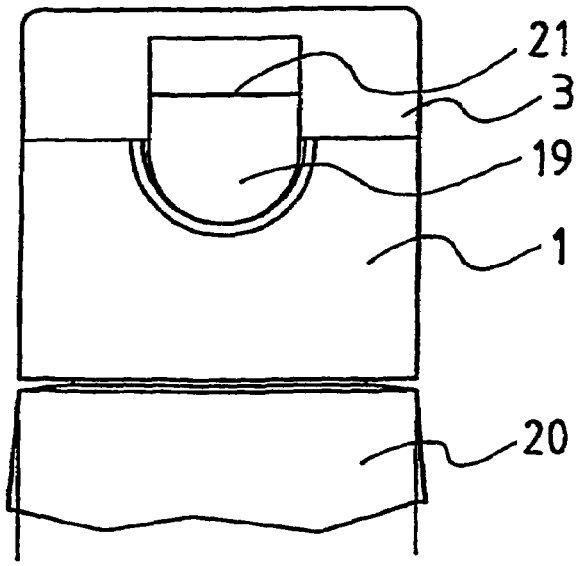
FIG. 2 is a front view of the closed guarantee closure, from the left as shown in FIG. 1.

The guarantee closure is shown in FIG. 2 in a front view, as seen from the left side of FIG. 1. The closure cap 3 comprises a tongue 19 which extends downwards and overlaps the closure body 1 at this location. The tongue 19 is advantageously via a thin location 21 set off somewhat from the remaining material of the closure cap 3 so that it may be slightly pivoted to the outside and may be gripped with two fingers. For opening the closure one grips the tongue 19 on the closure cap 3 and pivots up the closure cap 3 onto the closure body 1 lying thereunder about its hinge connection 18 arranged on the rear side.

Figure 3:
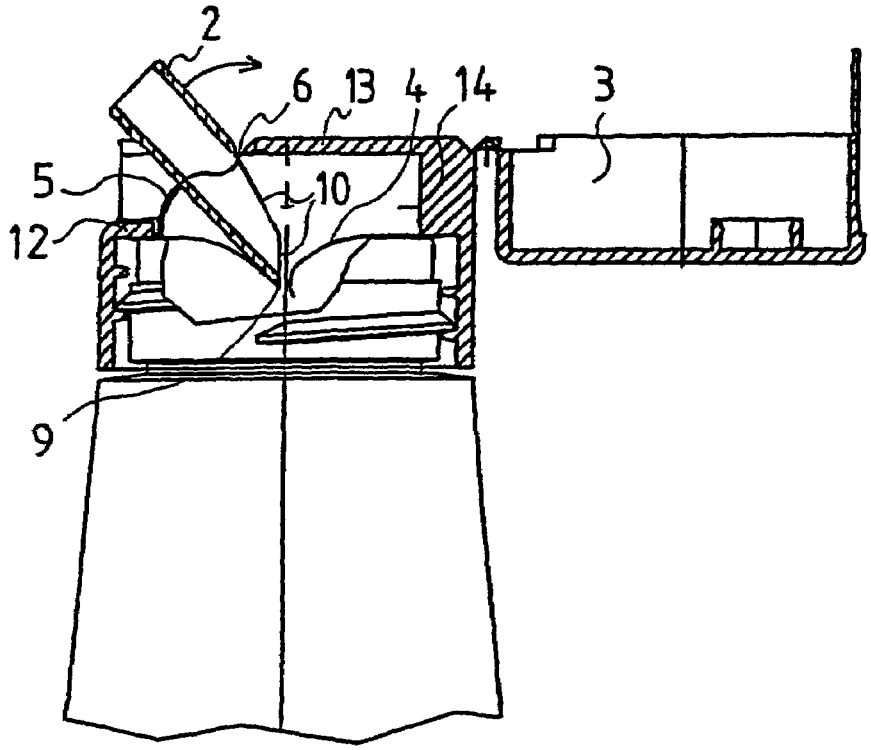
FIG. 3 is a longitudinal sectional view of the guarantee closure with a flipped-up closure cap, with the pour-out spout on pivoting tip, and simultaneous cutting open the guarantee foil.

FIG. 3 shows the guarantee closure in a longitudinal section with a closure cap 3 which has been flipped up. FIG. 3 shows the pivoting-up of the pour-out spout 2 and the cutting-open of the guarantee foil 4 which is effected at the same time. Specifically with two fingers a user grips the front part of the pour-out spout 2 which projects out of the material bridge 5 and pivots this up about the rotational axis 6 in the direction of the arrow. The pour-out spout 2 by way of pressing a thumb onto its opening and afterwards a pivoting movement of the thumb out of its lying position, may also be pivoted up about the rotation axis 6. As shown, at the same time the tip 9 of the lower end of the pour-out spout 2 tears a hole into the guarantee foil 4, and with a further pivoting up of the pour-out spout 2 the edges 10 cut further on both sides of the created hole so that out of the guarantee foil 4 a strip is cut out which is bent back by the further pivoting pour-out spout 2. FIG. 3 shows this pivoting-up movement during which the cutting-open of the guarantee foil 4 is effected, to half the path to be covered.

Figure 4:
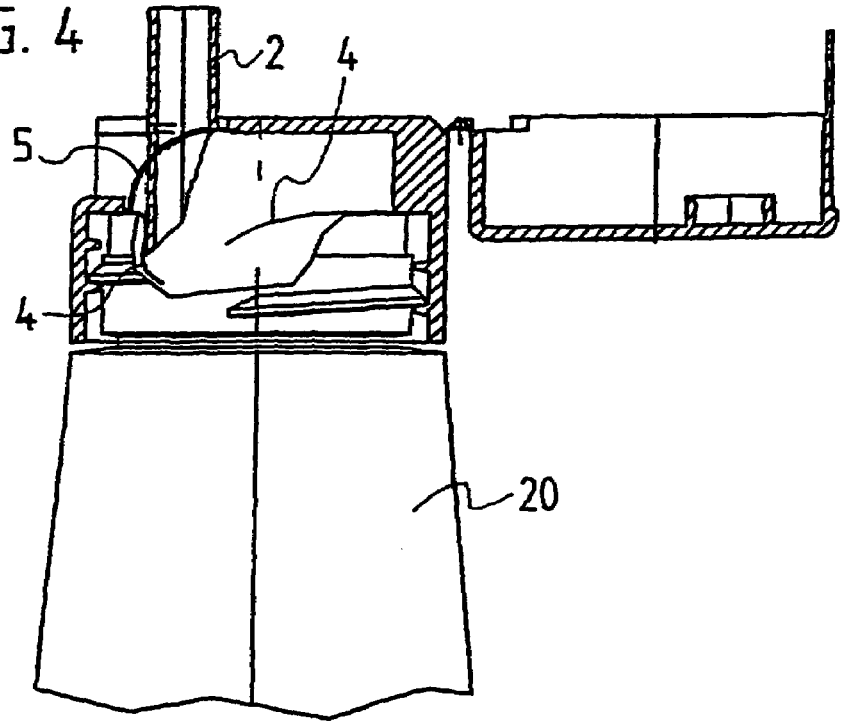
FIG. 4 is a longitudinal sectional view of the guarantee closure with a flipped-up closure cap, with the pour-out spout pivoted completely into the pour-out position after cutting-open the guarantee foil.

FIG. 4 shows the completion of this movement. Now the pour-out spout 2 has reached its pour-out position and the guarantee foil 4 is adequately cut open so that it sets free the cross section of the spout 2, and this also remains because the cut-open strip of the guarantee foil 4 is held back from the lower end of the pour-out spout 2. During the pivoting up of the pour-out spout 2 the film-hinge-like material bridge 5 is deformed and at the same time overcomes a dead center position. On overcoming this dead center position the material bridge 5 snaps from a shape which from the outside is firstly concave under which it developed a spring tension which kept the pour-out spout 2 in the lying position, into a convex shape, under which it develops a spring tension in the direction of the pivoting-up of the spout 2, and keeps it in the assumed pour-out position. The guarantee closure is now open and the bottle 20 is ready for pouring out its contents.

Figure 5:
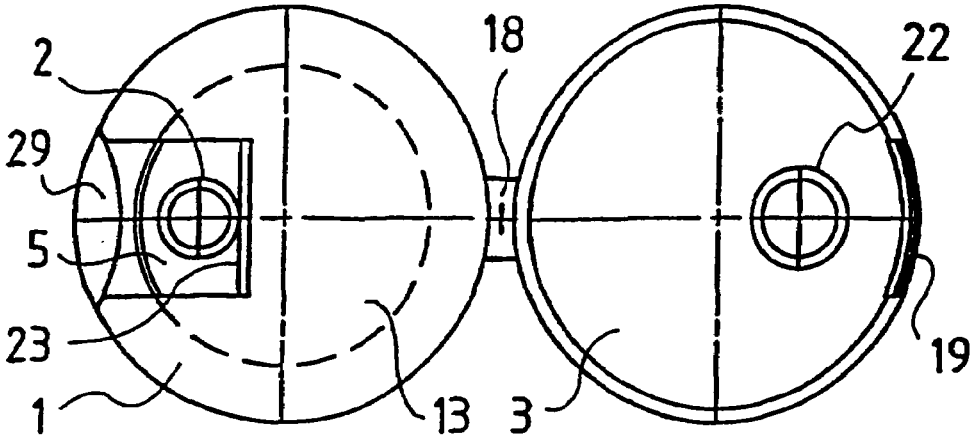
FIG. 5 is a top view of the guarantee closure with a flipped-up closure cap, with the pour-out spout in the pour-out position and a cut-open guarantee foil.

In FIG. 5 this position of the guarantee closure with a flipped-up closure cap 3 and with the pour-out spout 2 in the pour-out position and cut-open guarantee foil is shown seen from above. On the closure body 1 on its front side a concavity 29 is taken out which simplifies with a closed closure cap 3 the gripping of the tongue 19 overlapping this. The material 5 which is shown from above surrounds the pour-out spout 2 that belongs to the film-hinge-like material bridge 5 which thus is curved convexly outwards and on account of its spring tension keeps the spout 2 in the pour-out position 2. The upper shoulder 13 of the closure body 1 forms a recess 23, within which the material bridge 5 sealingly encloses the pour-out spout 2 so that the inside of the bottle exclusively communicates with the outside of the bottle. With an interrupted line the inner diameter of the closure body 1 is drawn in, over which the guarantee foil extends and in the condition shown is already cut open and displaced to the side, even if not shown. On the inner side of the closure cap 3 is a collar 22 for enclosing the opening edge of the pour-out spout 2 with the re-closed condition of the closure, so that this first is sealingly closed and second the position of the pour-out connection 2 is secured.

Figure 6:
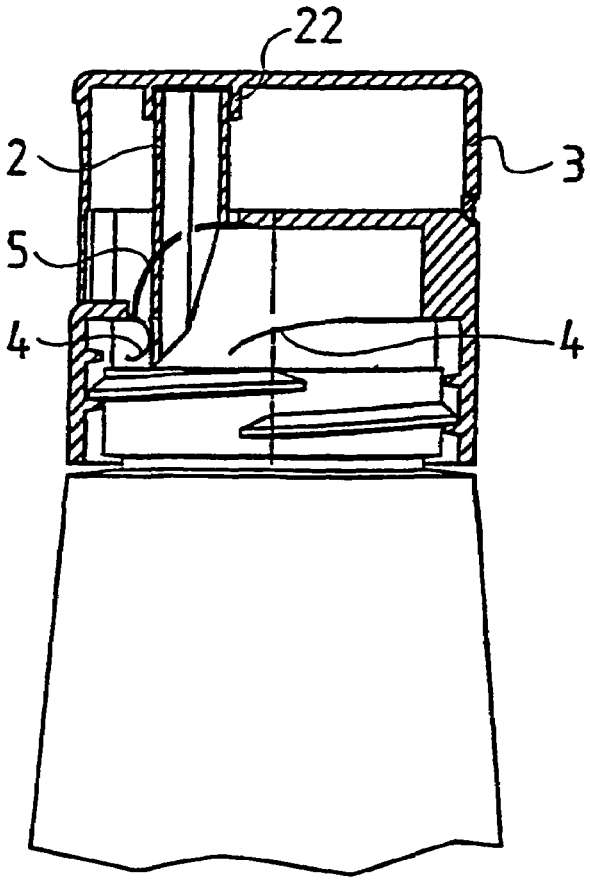
FIG. 6 is a longitudinal sectional view of the guarantee closure with a closure cap which is flipped shut again, with the pour-out spout remaining in the pour-out position after the use for the first time.

FIG. 6 shows the guarantee closure in a longitudinal section with a closure cap 3 which has been re-closed, with the pour-out spout 2 remaining in the pour-out position after use for the first time. The collar 22 on the closure cap 3 encloses the opening edge of the pour-out spout 2. The film-hinge material bridge 5 remains in its shape which is convex when viewed from the outside, and the lower end of the pour-out spout 2 presses the cut open guarantee foil 4 further to the side and thus keeps the pour-out free.

Figure 7:
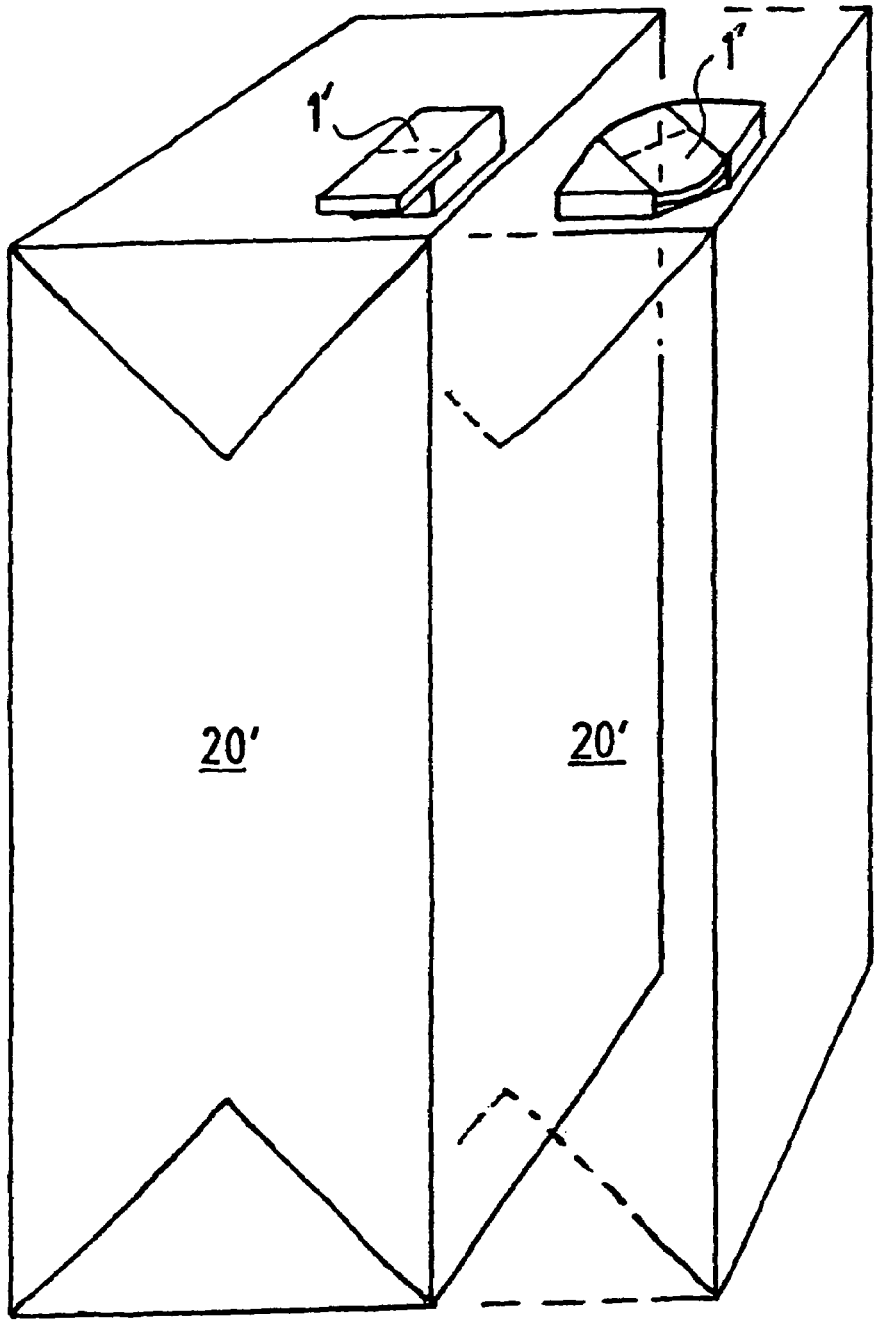
FIG. 7 is a diagrammatic view of the guarantee closure for a fluid and free-flowing material container in the form of a cuboid cardboard carton, left for pouring out the contents via a narrow side, and on the right is shown for pouring out the contents via a corner of the cuboid container.

In FIG. 7 the guarantee closure is shown in an application on a cardboard fluid carton or a cardboard free-flowing material carton. In the figure to the left is for pouring out the contents via a narrow side of the packaging carton and in the figure to the right is for pouring out the contents via a corner of the packaging carton. Such cardboard packagings are used for all sorts of fruit juices, lemonades, fresh water, tea and milk products, in many ccountries even wine. Furthermore also free-flowing material contents such as sugar and salt and similar products are packaged in such cardboard cartons. Instead of a circular shape as shown in the FIGS. 1 to 6 the guarantee closure shown here has in the example on the left a rectangular base shape and in the variant for building in the corner of a cardboard carton a boat-like base shape. The closure positioned in the corner is advantageous because the contents which indeed runs better together here, may be emptied from the carton without any remains. Furtherbase shapes of the closure are possible depending on the particularities and the shaping of the packaging. The guarantee closure 1' may be adhered onto the cardboard carton 20' or may be connected sealingly to the cardboard carton 20' by way of an ultrasonic welding. In this case a plastic foil is applied below the upper closure surface of the cardboard carton and the closure then with the cardboard carton closure surface is welded to the plastic foil applied thereunder at least at locations by way of an ultrasonic welding.

Figure 8:
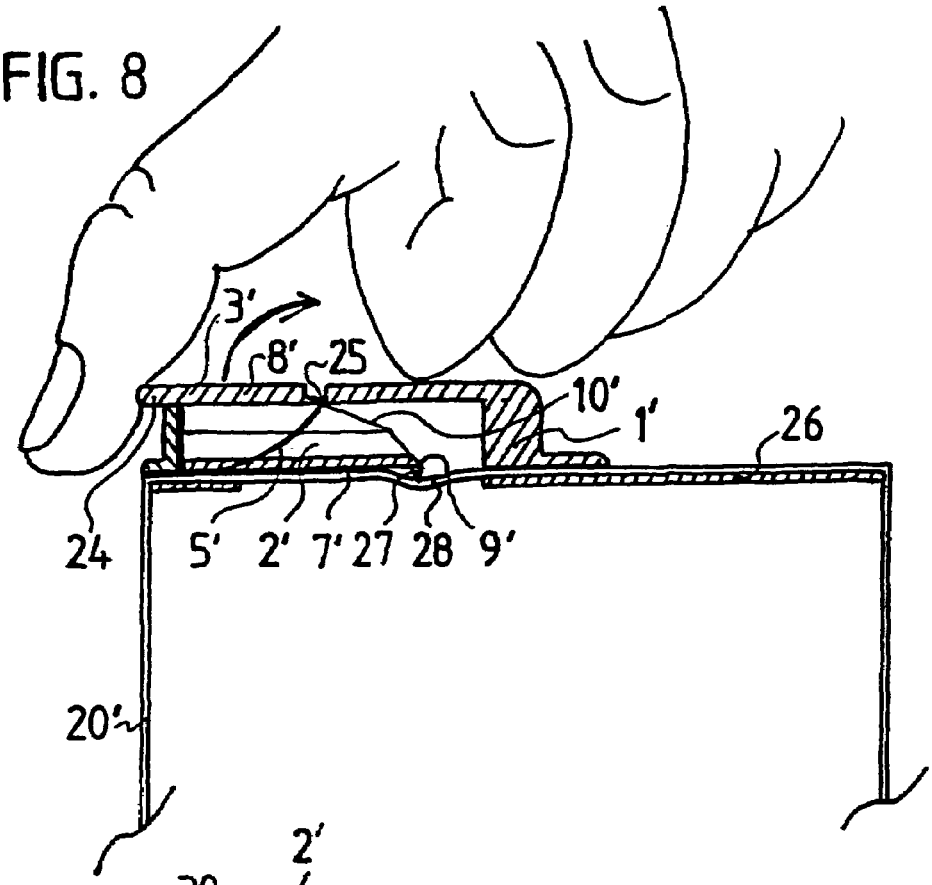
FIG. 8 is a longitudinal sectional side view of the guarantee closure according to FIG. 7 on the left, before pivoting up the pour-out spout.

As shown in FIG. 8 the closure cap 3' is formed as a flat lid and overlaps the closure body to the front, as shown to the left in the drawing, while the closure cap hinge 25 is arranged roughly in the middle of the closure length. The front part of the lid may be pivoted upwards about the hinge axis 25 which is drawn in with the arrow, for which the closure cap 3' at its front, projecting edge 24 may be gripped. Most simply one places the thumb below the edge 24 of the closure cap 3', as shown in the drawing, and then pulls it up. The lower side of the upwardly pivotable closure cap there is formed a pour-out spout 2'. This on its rear side or the lower side in the pivoted up condition is chamfered and thus tapers towards that end which on pivoting-up is pivoted towards the container 20' into a tip 9'. Thus from its wall there are formed two edges 10' which taper at an askew angle to the tip 9'. Pointing downwards as shown here on the tip 9' there may be a perforating tip 27 which may be formed by a plastic cone pointing downwards with the tip, wherein the tip of the cone may taper into a sharp, short needle, or the perforating tip is formed by a large-surfaced plastic triangle aligned along the pour-out spout axis, with a sharp tip. The lower rear longitudinal side 7' of the pour-out spout 2' is formed into a sharp, wedge-shaped longitudinal edge which may act as a cutting edge, as will be explained. Below the closure there extends the cardboard of the liquid or loose material carton and by the tip 27 is pressed slightly downwards. The closure is from above glued onto the cardboard carton or connected to a plastic foil 26 applied below the cardboard by way of ultrasonic welding.

Figure 9:
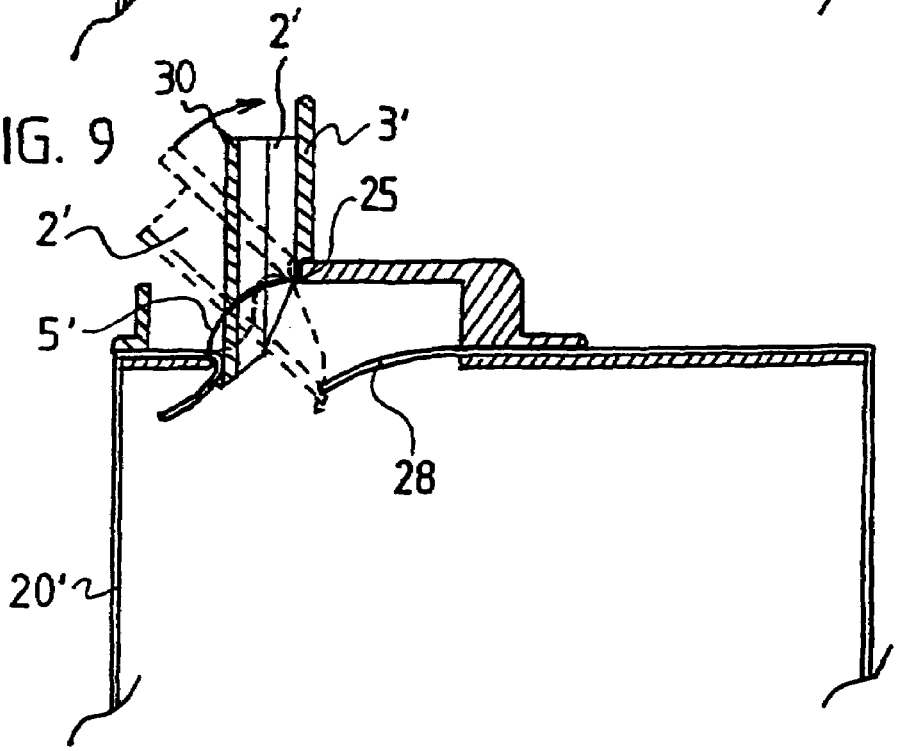
FIG. 9 is a longitudinal sectional side view of the guarantee closure according to FIG. 8, after pivoting up the pour-out spout into the pour-out position and after an effected piercing and cutting open of the cardboard carton upper side acting as a guarantee foil.

FIG. 9 shows how the closure functions. Firstly with one finger, best of all the thumb the closure lid 3' at its edge 24 is gripped and flipped up about the hinge axis 25, by which simultaneously the pour-out spout 2' arranged on the lower side of the closure lid 3' is pivoted by 90° into the vertical position. On the outside between the pivotable pour-out spout 2' and the closure housing 1' there is located a thin sealing membrane 5' in the shape of a film-hinge material bridge which in the initial position with a lying pour-out spout 2' as shown in FIG. 8 when viewed from the outside, and as seen from the left in the drawing, is curved concavely. On pivoting up the closure cap 3' and the pour-out spout 2' formed thereon this membrane 5' springs into a convex shape and develops in this position a force in the direction of the pivoting-up of the pour-out spout 2'. Because the pivoting axis is arranged roughly in the middle of the length of the pour-out spout 2' on pivoting up this, its rear, specially formed part flips downwards. At the same time the perforating tip 27 presses on the cardboard of the liquid carton 20' and tears a hole in this. This is extremely important since only proceeding from such a tear location may the thick cardboard 28 be cut open further. On flipping up the pour-out spout 2' the lower wedge-shaped longitudinal edge of the pour-out spout 2' presses onto the tear location and this lower edge on the spout 2' acting as a knife cuts open the cut-open hole even more so that the lower part of the pour-out spout 2' finally projects into the inside of the cardboard carton 20' and this is opened. In FIG. 9 for an improved understanding a middle pivot position of the closure lid 3' and pour-out spout 2' is shown dashed. Finally the pour-out spout 2' reaches the vertical position in which the sealing membrane 5' seen from the outside is convexly curved and retains the pour-out spout 2' in this position. If the pour-out spout 2' after pouring out the desired liquid quantity is pivoted down again, the membrane 5' springs again into its concave shape and retains the spout 2' in the lying position. So that the fluid contents may be poured out cleanly, the edge of the pour-out spout 2' may have a drip lug 30.

The invention claimed is:

1. A guarantee closure for a liquid and free-flowing material container (20, 20') having a closure body (1) with a pour-out spout (2, 2') arranged therein in an initial position and which is pivotable up out of the initial position and which with respect to the closure body (1) is sealingly enclosed by a film-hinge material bridge (5,5') which on pivoting up the pour-out spout (2, 2') springs from a concave into a convex shape and vice-versa and thus retains the pour-out spout (2, 2') in end positions of a pivoting range, and an associated guarantee foil (4, 28) which in the lying position of the pour-out spout (2, 2') extends below and along the lying position, wherein a pivoting axis on the pour-out spout (2, 2') is at a location so that a rear section of the pour-out spout (2, 2') on pivoting-up the pour-out spout (2, 2') pivots downwards, the guarantee closure comprising:

a lower, rear end of the pour-out spout (2, 2') in the lying position tapering into a tip (9, 9') and from a wall are formed two edges (10') tapering at an askew angle to a pour-out spout axis to the tip (9'), the tip (9') tapering into a perforating tip (27) by forming one of a plastic cone pointing toward the guarantee foil (28) and a large-surfaced plastic triangle aligned along the pour-out spout axis, with a sharp tip directed downwards, the pour-out spout (2,2') in the lying position forming on a lower longitudinal side behind the film-hinge material bridge (5,5') a sharp wedge-shaped longitudinal edge, and on pivoting up the pour-out spout (2, 2') at first the guarantee foil (28) being pierced open by the perforating tip (27) and then starting at the piercing point being cut open by the longitudinal edge, the closure cap (3) via a film hinge (18) connected as one piece to the closure body (1) and can be flipped up whereby the closure cap (3) in a closed position is lockable into the closure body (1) and bears on an inner side a collar (22) which in a flipped up position of the pour-out spout (2) and closed closure cap (3) encloses an opening edge of the pour-out spout (2) so that the pour-out spout (2) in the flipped up position is sealed and secured.

2. A guarantee closure for a fluid and free-flowing material container (20, 20') according to claim 1, wherein the pour-out spout (2, 2') in the lying position in the closure body (1) on a lower side (7, 7') in a direction of an end to be pivoted towards the container (20, 20') is longer than on an upper side (8, 8') so that at the end tapers at the askew angle to the axis of the pour-out spout (2, 2') into a tip (9, 9') and the edges (10, 10') tapering at the askew angle to the lower end of the pour out spout (2, 2') are formed as cutting edges.

3. A guarantee closure for a liquid and free-flowing material container (20) according to claim 1, wherein the closure body (1) comprises a relief (11) for receiving the guarantee foil (4), and above the relief (11) by two shoulders (12,13) arranged over one another and distanced from one another forms a free space (14) for receiving the lying pour-out spout (2), wherein the pour-out spout (2) is enclosed by a film-hinge material bridge (5) which in the lying position connects the two shoulders (12, 13) with a surface which is concave when viewed from an outside and on the upper side of the lying pour-out spout (2) runs together at a point which defines the pivoting axis (6) of the pour-out spout (2).

4. A guarantee closure for a liquid and free-flowing material container (20) according to claim 3, wherein the closure cap (3) on the inner side has the collar (22) for receiving the upper edge of the pivoted-up pour-out spout (2) and the closure cap (3) by a snap closure is one of stuck onto the closure body (1) and by an inner thread is screwed onto the closure body (1) with an outer thread.

5. A guarantee closure for a liquid and free-flowing material container (20) according to claim 4, wherein the closure body (1) has an inner thread (15) for screwing onto an outer thread (16) of a bottle neck (17).

6. A guarantee closure for a liquid and free-flowing material container (20) according to claim 5, wherein the upper shoulder (13) of the closure body (1) comprises a recess (23) within which the pour-out spout (2) is sealingly enclosed by the film-hinge material bridge (5).

7. A guarantee closure for a liquid and free-flowing material container (20) according to claim 1, wherein the closure body (1) has an inner thread (15) for screwing onto an outer thread (16) of a bottle neck (17).

8. A guarantee closure for a liquid and free-flowing material container (20) according to claim 1, wherein the upper shoulder (13) of the closure body (1) comprises a recess (23) within which the pour-out spout (2) is sealingly enclosed by the film-hinge material bridge (5).

9. A guarantee closure for a liquid and free-flowing material container (20.20') having a closure body (1) with a pour-out spout (2, 2') arranged therein in an initial position and which is pivotable up out of the initial position and which with respect to the closure body (1) is sealingly enclosed by a film-hinge material bridge (5,5°) which on pivoting up the pour-out spout (2, 2') springs from a concave into a convex shape and vice-versa and thus retains the pour-out spout (2, 2') in end positions of a pivoting range, and an associated guarantee foil (4, 28) which in the lying position of the pour-out spout (2, 2') extends below and along the lying position, wherein a pivoting axis on the pour-out spout (2, 2') is at a location so that a rear section of the pour-out spout (2, 2') on pivoting-up the pour-out spout (2, 2') pivots downwards, the guarantee closure comprising:

a lower, rear end of the pour-out spout (2, 2') in the lying position tapering into a tip (9, 9') and from a wall are formed two edges (10') tapering at an askew angle to a pour-out spout axis to the tip (9'), the tip (9') tapering into a perforating tip (27) by forming one of a plastic cone pointing toward the guarantee foil (28) and a large-surfaced plastic triangle aligned along the pour-out spout axis, with a sharp tip directed downwards, the pour-out spout (2,2°) in the lying position forming on a lower longitudinal side behind the film-hinge material bridge (5,5°) a sharp wedge-shaped longitudinal edge, and on pivoting up the pour-out spout (2, 2') at first the guarantee foil (28) being pierced open by the perforating tip (27) and then starting at the piercing point being cut open by the longitudinal edge, the pour-out spout (2, 2') in the lying position in the closure body (1) on a lower side (7, 7') in a direction of an end to be pivoted towards the container (20, 20') being longer than on an upper side (8, 8') so that at the end tapers at the askew angle to the axis of the pour-out spout (2, 2') into a tip (9, 9') and the edges (10, 10') tapering at the askew angle to the lower end of the pour out spout (2, 2') are formed as cutting edges.

10. A guarantee closure for a liquid and free-flowing material container (20, 20') having a closure body (1) with a pour-out spout (2, 2') arranged therein in an initial position and which is pivotable up out of the initial position and which with respect to the closure body (1) is sealingly enclosed by a film-hinge material bridge (5,5°) which on pivoting up the pour-out spout (2, 2') springs from a concave into a convex shape and vice-versa and thus retains the pour-out spout (2, 2') in end positions of a pivoting range, and an associated guarantee foil (4, 28) which in the lying position of the pour-out spout (2, 2') extends below and along the lying position, wherein a pivoting axis on the pour-out spout (2, 2') is at a location so that a rear section of the pour-out spout (2, 2') on pivoting-up the pour-out spout (2, 2') pivots downwards, the guarantee closure comprising:

a lower, rear end of the pour-out spout (2, 2') in the lying position tapering into a tip (9, 9') and from a wall are formed two edges (10') tapering at an askew angle to a pour-out spout axis to the tip (9'), the tip (9') tapering into a perforating tip (27) by forming one of a plastic cone pointing toward the guarantee foil (28) and a large-surfaced plastic triangle aligned along the pour-out spout axis, with a sharp tip directed downwards, the pour-out spout (2,2°) in the lying position forming on a lower longitudinal side behind the film-hinge material bridge (5,5°) a sharp wedge-shaped longitudinal edge, and on pivoting up the pour-out spout (2, 2') at first the guarantee foil (28) being pierced open by the perforating tip (27) and then starting at the piercing point being cut open by the longitudinal edge the closure body (1) comprises a relief (11) for receiving the guarantee foil (4), and above the relief (11) by two shoulders (12,13) arranged over one another and distanced from one another forms a free space (14) for receiving the lying pour-out spout (2), wherein the pour-out spout (2) is enclosed by a film-hinge material bridge (5) which in the lying position connects the two shoulders (12, 13) with a surface which is concave when viewed from an outside and on the upper side of the lying pour-out spout (2) runs together at a point which defines the pivoting axis (6) of the pour-out spout (2).

11. A guarantee closure for a liquid and free-flowing material container (20, 20') according to claim 10, wherein the closure cap (3) via a film hinge (18) is connected as one piece to the closure body (1) and can be flipped up whereby the closure cap (3) in a closed position is lockable into the closure body (1) and bears on an inner side a collar (22) which in a flipped up position of the pour-out spout (2) and closed closure cap (3) encloses an opening edge of the pour-out spout (2) so that the pour-out spout (2) in the flipped up position is sealed and secured.

12. A guarantee closure for a liquid and free-flowing material container (20, 20') having a closure body (1) with a pour-out spout (2, 2') arranged therein in an initial position and which is pivotable up out of the initial position and which with respect to the closure body (1) is sealingly enclosed by a film-hinge material bridge (5,5°) which on pivoting up the pour-out spout (2, 2') springs from a concave into a convex shape and vice-versa and thus retains the pour-out spout (2, 2') in end positions of a pivoting range, and an associated guarantee foil (4, 28) which in the lying position of the pour-out spout (2, 2') extends below and along the lying position, wherein a pivoting axis on the pour-out spout (2, 2') is at a location so that a rear section of the pour-out spout (2, 2') on pivoting-up the pour-out spout (2, 2') pivots downwards, the guarantee closure comprising:

a lower, rear end of the pour-out spout (2, 2') in the lying position tapering into a tip (9, 9') and from a wall are formed two edges (10') tapering at an askew angle to a pour-out spout axis to the tip (9'), the tip (9') tapering into a perforating tip (27) by forming one of a plastic cone pointing toward the guarantee foil (28) and a large-surfaced plastic triangle aligned along the pour-out spout axis, with a sharp tip directed downwards, the pour-out spout (2,2°) in the lying position forming on a lower longitudinal side behind the film-hinge material bridge (5,5°) a sharp wedge-shaped longitudinal edge, and on pivoting up the pour-out spout (2, 2') at first the guarantee foil (28) being pierced open by the perforating tip (27) and then starting at the piercing point being cut open by the longitudinal edge, the closure cap (3) on the inner side having a collar (22) for receiving the upper edge of the pivoted-up pour-out spout (2) and the closure cap (3) by a snap closure being one of stuck onto the closure body (1) and by an inner thread being screwed onto the closure body (1) with an outer thread.

* * * * *